United States Patent [19]

Hawk

[11] Patent Number: 5,050,844

[45] Date of Patent: Sep. 24, 1991

[54] LIFT ASSEMBLY

[75] Inventor: Marion N. Hawk, Gladstone, Mo.

[73] Assignee: VBM Corporation, Louisville, Ky.

[21] Appl. No.: 417,488

[22] Filed: Oct. 5, 1989

[51] Int. Cl.[5] ..... B66F 3/00

[52] U.S. Cl. ..... 254/89 H; 254/90

[58] Field of Search ..... 254/8 R, 8 B, 8 C, 89 H, 254/90, 93 R, 93 H, 124, 10 R, 10 B, 10 C, 124, 88; 187/8.47, 8.49, 8.50, 8.41, 8.71, 8.72, 40, 41; 137/497–498

[56] References Cited

U.S. PATENT DOCUMENTS

| | | | |
|---|---|---|---|
| 3,178,156 | 4/1965 | Rigers | 254/88 |
| 3,317,004 | 5/1967 | Harrison | 254/10 C |
| 4,050,673 | 9/1977 | Nishimura | 254/89 H |
| 4,230,304 | 10/1980 | Tol | 254/89 H |
| 4,241,901 | 12/1980 | Shircliffe | 254/89 H |
| 4,251,974 | 2/1981 | Vanderklaauw | 254/89 H |
| 4,815,712 | 3/1989 | Kawada | 254/89 H |
| 4,848,732 | 7/1989 | Rossato | 254/89 H |

*Primary Examiner*—Robert C. Watson

*Attorney, Agent, or Firm*—Fay, Sharpe, Beall, Fagan, Minnich & McKee

[57] ABSTRACT

A lift assembly adapted for large vehicles includes first and second lift platforms selectively raised and lowered relative to a base member. Fluid actuated support arms are interposed between the lift platforms and the base member to define a generally trapezoidal arrangement. Segmented bearings are interposed between opposite ends of the support arms and the lift platforms and base member to accommodate tolerance stackup. The lift assembly also includes a sensing assembly that determines if a height differential exists between the lift platforms. If a height differential is sensed, movement of one of the lift platforms is altered to correct the situation. If too great a differential is sensed, further movement of the platforms is terminated. A locking arrangement maintains the lift platforms elevated relative to the base member. A sensing arrangement determines whether the locking arrangement is properly oriented and whether the load is applied from the lift platforms. Lift jack assemblies are provided to selectively lift the vehicle relative to the lift platform. A multiplexing arrangement is provided to synchronize movement between the lift jack assemblies. Further, the lift jack assemblies may be comprised of single acting fluid cylinders that are retracted with a bidirectional pump.

35 Claims, 9 Drawing Sheets

FIG. 6
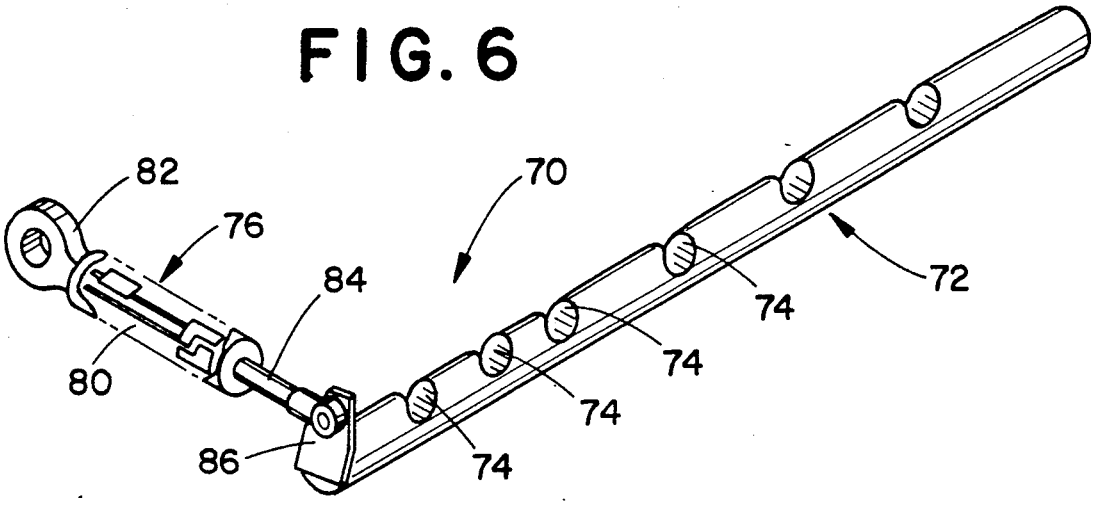
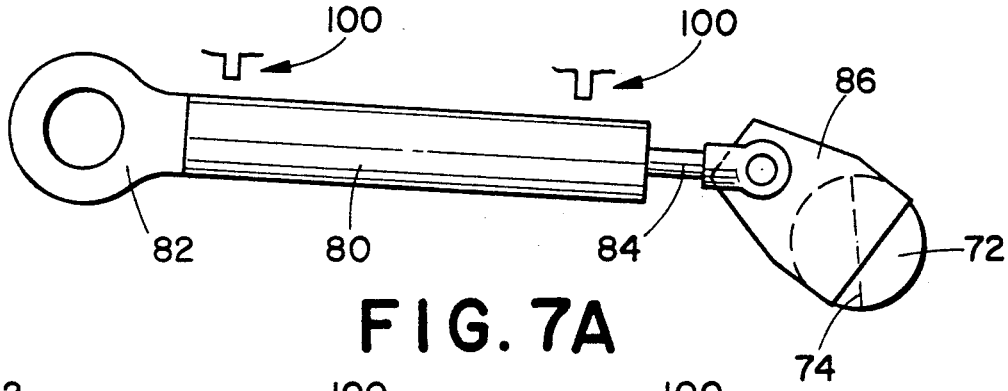
FIG. 7A
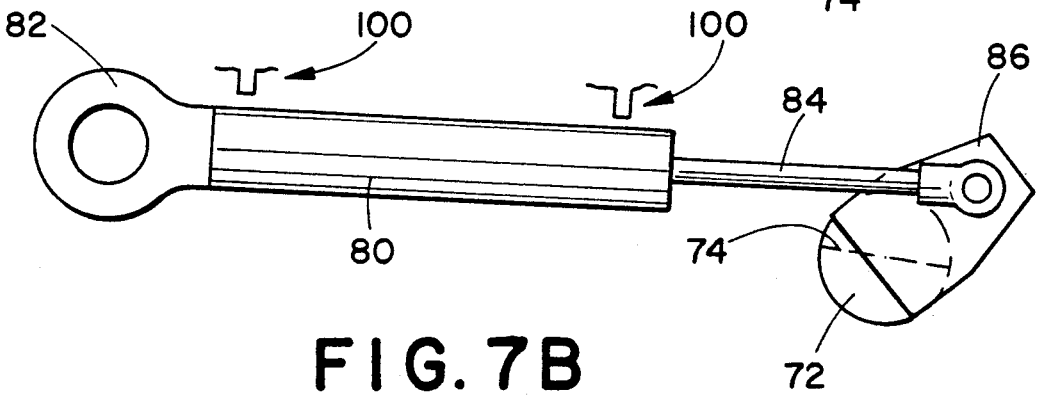
FIG. 7B
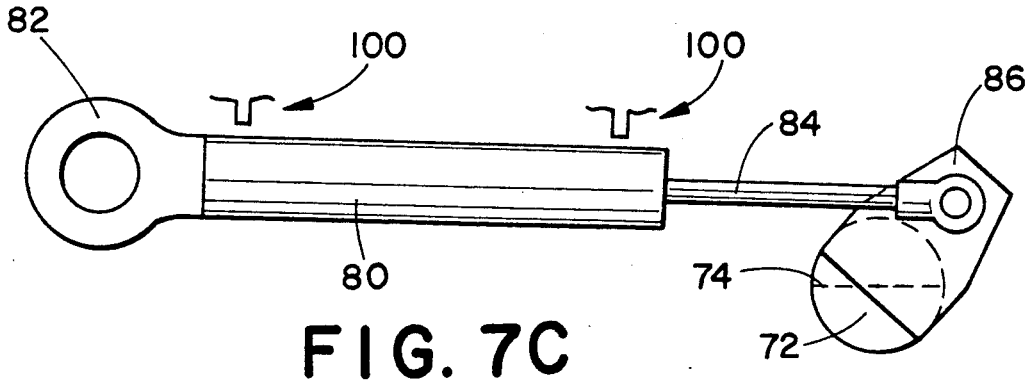
FIG. 7C

LIFT ASSEMBLY

BACKGROUND OF THE INVENTION

This invention pertains to the art of lift assemblies and more particularly, to electromechanical lift assemblies.

The invention is applicable to a lift assembly adapted for a large vehicle such as a bus, trash truck, rail car and the like to permit repair and maintenance on the underside of the vehicle, and will be described with particular reference thereto. However, it will be appreciated that the invention has broader applications and may be advantageously employed in other environments and applications requiring an elevation of large loads.

Prior heavy-duty lift assemblies have employed a basic four bar linkage arrangement with additional features to adapt the linkage arrangement to lifting a large vehicle. Although these modified constructions are considered state of the art, a closer review of the design and operation of these heavy-duty lift assemblies has revealed some potential areas for improvement.

For example, a four bar linkage assembly is particularly sensitive to tolerance stackup problems. That is, in design, one part is dimensioned for a precise fit with another part, but during manufacture tolerance variations in the components accumulate or "stack up" resulting in an assembled product that does not meet anticipated design precision.

To permit work on the underbelly of the vehicles, heavy-duty lift assemblies typically include a base member defined by a pair of base member portions maintained in a predetermined, spaced relation. First and second lift platforms are associated with the first and second base member portions, respectively, and together define a lift member selectively elevated relative to the base member. Raising is usually achieved by using fluid cylinders. The fluid cylinders are associated with linkage members that are connected at opposite ends to the base member and lift platform.

In an attempt to provide synchronized movement of the lift platforms, prior devices use a rigid torque tube extending between the first and second lift platforms. It has even been suggested to use an optical sensor in conjunction with the torque tube to indicate whether one lift platform has been elevated to a different height than the other lift platform. Unfortunately, these prior systems merely terminate movement as soon as a predetermined height differential between the lift platforms is encountered.

Inadvertent failure of the fluid cylinders providing the lifting force to the linkage members could be catastrophic. Thus, a secondary or backup arrangement is normally provided should such a failure occur. No known lift assembly system provides a positive indication of the readiness of the backup arrangement.

Another conventional feature of prior heavy-duty lift assemblies is the use of a pair of lift jacks to independently raise the wheels of the vehicle relative to the lift platforms. Typically, a carrier member extends transversely between the lift platforms. The carrier member may be slid longitudinally along the area between the lift platforms to position the lift jacks at a desired location. Unfortunately, tolerance stackup problems may result in non-parallel lift platforms that prevent free movement of the carrier member longitudinally between the lift platforms. Heretofore the carrier member has not been able to adequately adapt to this problem.

Still further, the lift jacks usually have a manually adjustable portion that permits an operator to advance the lift jack into abutting engagement with the undercarriage of the vehicle before the lift jack is raised under fluid power. For example, a threaded arrangement permits selective rotation in one direction to raise the manually adjustable portion, while rotation in the opposite direction lowers the manually adjustable portion of the lift jack. Oftentimes, the manually adjustable portion becomes separated from the remainder of the lift jack and is therefore unable to support any load until the problem is resolved.

Use of fluid power to operate the lift jacks also leaves fluid lines exposed to potential abrasion or other problems. Thus, it has been considered desirable to limit the number of fluid lines in the lift assembly.

Still another problem associated with use of a pair of lift jack assemblies is the need to synchronize movement to provide a stable, even lift of the vehicle relative to the lift platforms. Typically, a double acting cylinder is employed to permit positive retraction of the lift jack by operating a pump in reverse. A double acting cylinder, unfortunately, represents an increase in price over an otherwise comparable single acting cylinder. Further, a single acting cylinder is not considered as desirable since the pump cannot be utilized to retract the cylinder after extension.

SUMMARY OF THE INVENTION

The present invention contemplates a new and improved lift assembly that overcomes all of the above referred to problems and others, and provides a reliable, safe, and economic assembly.

According to the present invention, the lift assembly includes a base member having first and second lift platforms selectively moved toward and away from the base member. Means for synchronizing movement of the first and second platforms is provided.

According to another aspect of the invention, the synchronizing means includes means for sensing the height differential between the lift platforms, and regulating movement of the lift platforms in response to the sensing means.

According to a further aspect of the invention, means for locking the lift platforms at a predetermined position is provided.

In accordance with a still further aspect of the invention, the locking means includes means for indicating an engaged and loaded condition.

According to an alternate aspect of the invention, arms link the lift platforms to the base member and a segmented bearing assembly is provided at opposite ends of the arms to accommodate tolerance stackup.

According to a further aspect of the invention, a lift jack assembly is provided for raising and lowering loads relative to the lift platforms. The lift jack assembly includes means for operating a pump in reverse to retract a single acting fluid cylinder.

According to another aspect of the invention, the lift jack assembly includes extension limit warning indicia and an extension for supporting a load, yet preventing further advancement of the lift jack assembly.

According to a still further aspect of the invention, means for synchronizing movement of two lift jack assemblies is provided.

A principal advantage of the invention resides in the lock system that verifies engagement and loading of the lift platforms.

Another advantage of the invention resides in the equalizing and lockup sensing arrangement that provides a signal indicating non-synchronous movement of the lift platforms and regulates movement of the lift platforms in response thereto.

Yet another advantage of the invention resides in the segmented bearings that overcome tolerance stackup problems and permit transfer of tensile and compressive forces therethrough.

Still another advantage is realized by synchronizing the movement of the lift jack assemblies.

A still further advantage of the invention resides in the ability to use a pump to retract a single acting cylinder.

Still other advantages and benefits of the invention will become apparent to those skilled in the art upon a reading and understanding of the following detailed description.

BRIEF DESCRIPTION OF THE DRAWINGS

The invention may take physical form in certain parts and arrangements of parts, a preferred embodiment of which will be described in detail in this specification and illustrated in the accompanying drawings which form a part hereof, and wherein:

FIG. 6 is a perspective view of a lock bar and actuator assembly used with the subject invention;

FIGS. 7A–C are side elevational views in partial cross section of the actuator of FIG. 6 in (i) retracted, (ii) extended or overcenter, and (iii) engaged/loaded positions;

DETAILED DESCRIPTION OF THE PREFERRED EMBODIMENT

Figure 1:
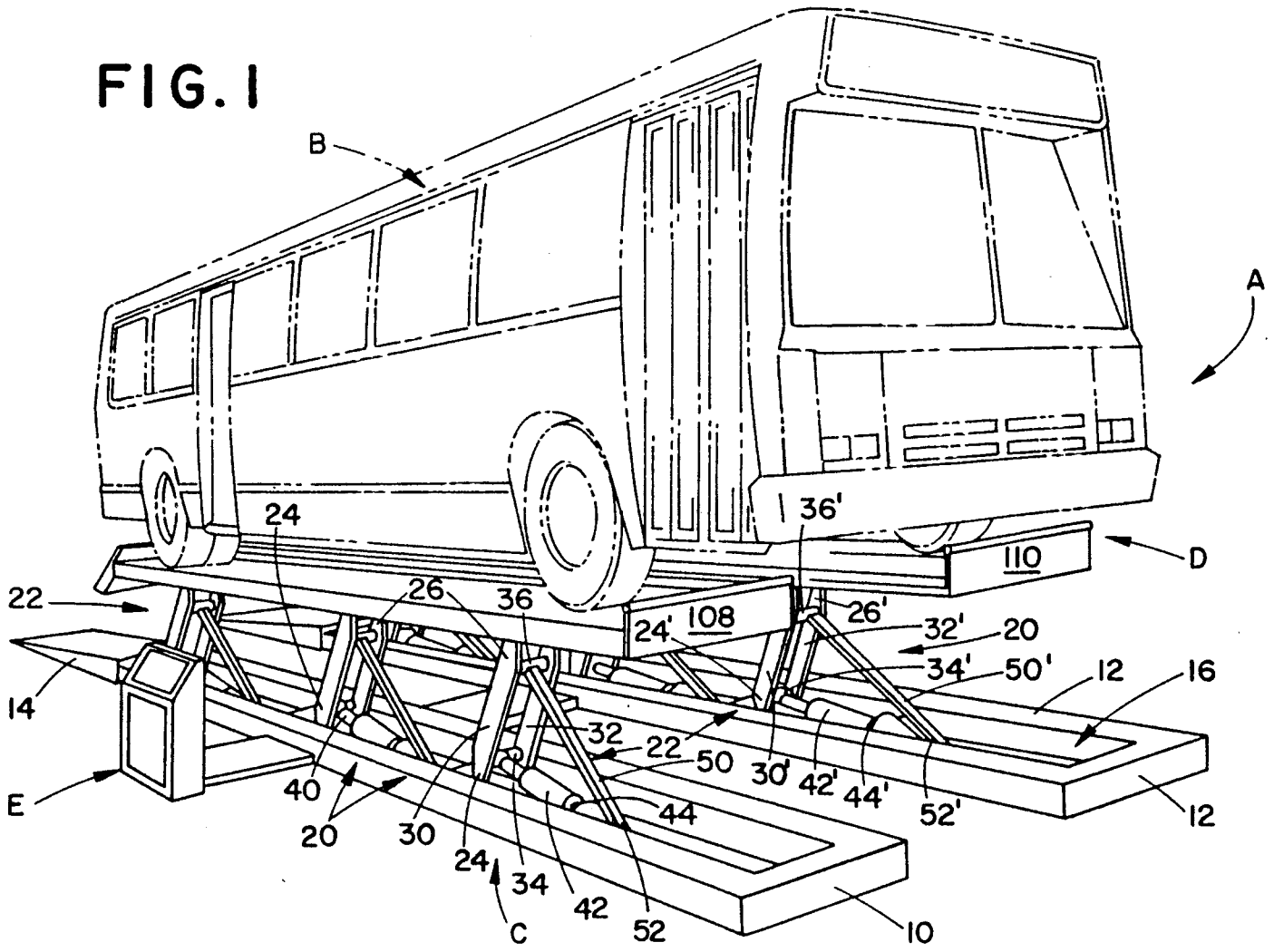
FIG. 1 is a perspective view of the subject new lift assembly elevating a heavy load such as a bus shown in phantom.

Referring now to the drawings wherein the showings are for purposes of illustrating the preferred embodiment of the invention only and not for purposes of limiting same, the FIGURES show a lift assembly A adapted to support a load such as a large vehicle B. The lift assembly includes a base member C and lift member D raised and lowered relative to the base member through suitable controls on control panel E.

Figure 2:
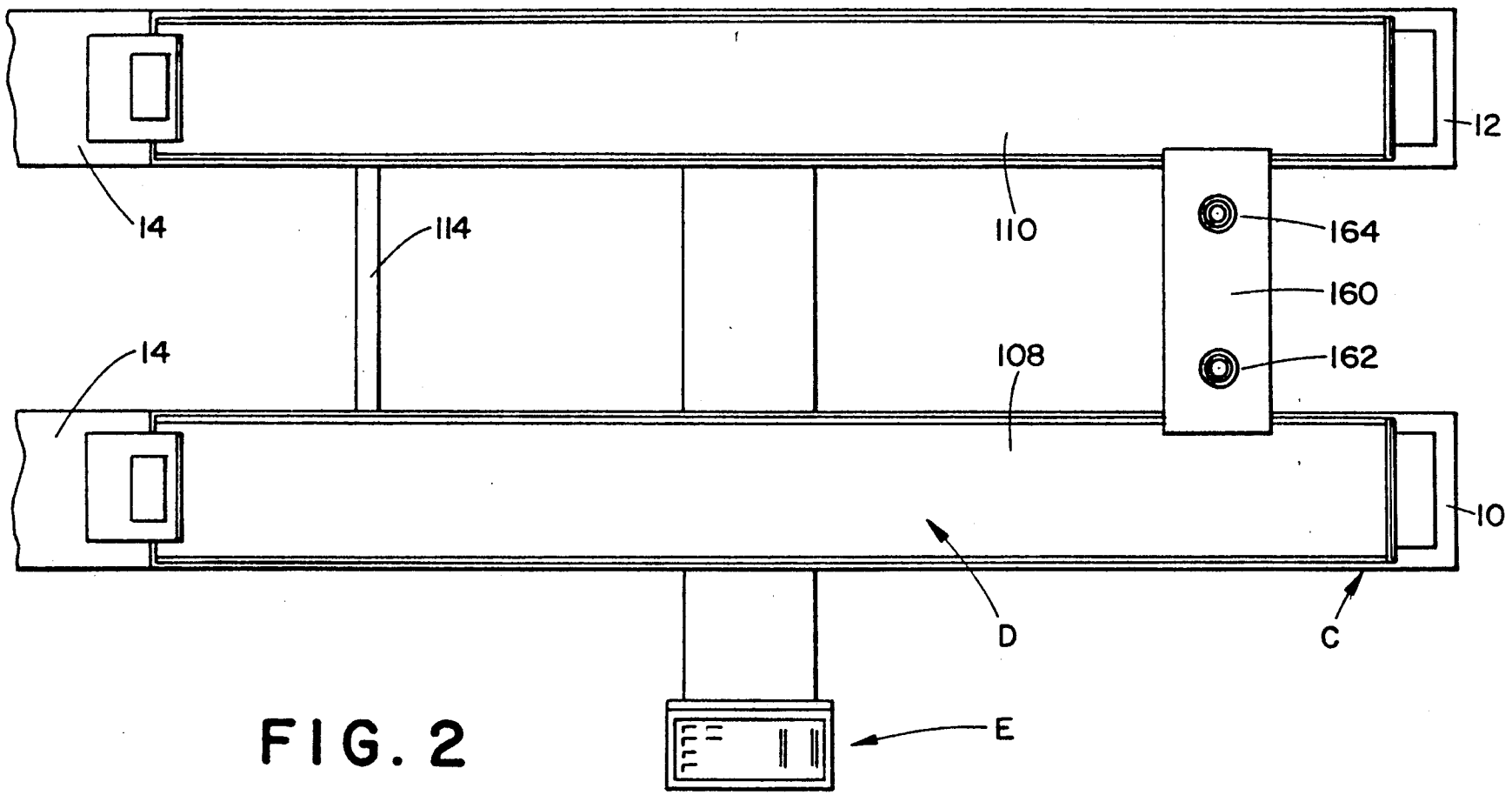
FIG. 2 is an overhead plan view of the lift assembly.
Figure 3:
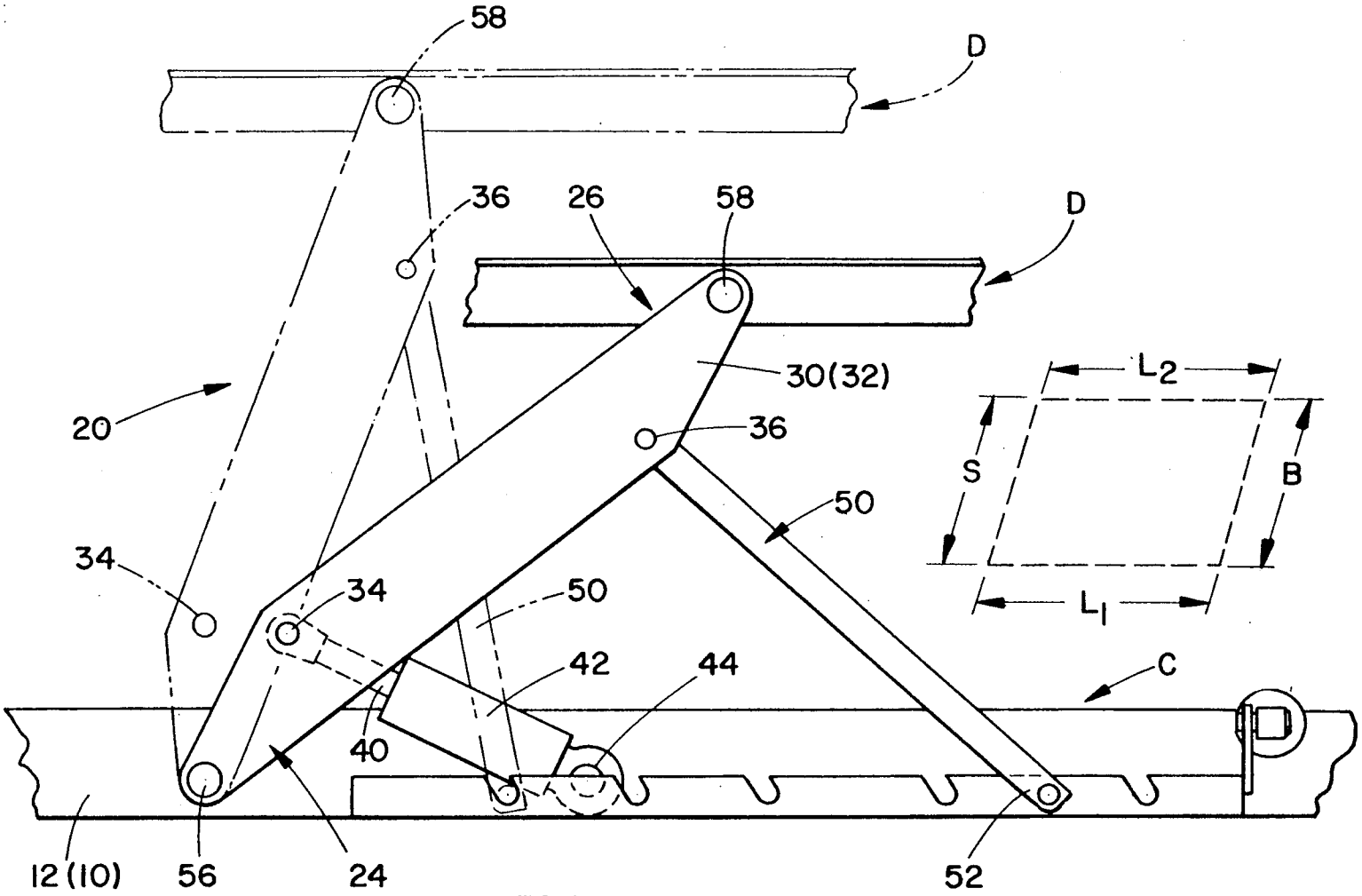
FIG. 3 is a side elevational view of the assembly illustrating the lift platforms at an intermediate position shown in solid line and the fully raised position shown in phantom.

With particular reference to FIGS. 1–3, the base member C includes first and second base portions 10, 12 that have ramps 14 disposed at one end, or, alternately, at both ends for a drive through arrangement. Each base member portion has an interior cavity 16 adapted to receive means 20 for moving the lift member D relative to the base member.

More particularly, the moving means 20 includes pairs of support arms 22 received in the base portions 10, 12. That is, the support arms work in tandem and for ease of illustration and understanding, a support arm in the second base portion 12 is identified with a primed suffix (') to indicate that it is substantially identical to the support arm in the first base portion 10. Each support arm is pivoted at opposite ends 24, 26 to the base member and lift member, respectively. According to the preferred arrangement, each support arm is defined by first and second parallel members 30, 32 that are maintained in spaced relation by pins 34, 36. Secured to the first pin is the rod 40 of a fluid cylinder 42. The opposite end, or head end, 44 of the fluid cylinder is secured to base member so that selective extension of the fluid cylinder pivots the support arm 22 outwardly from the base member while retraction of the fluid cylinder draws the support arm into the cavity 16. A lock arm 50 is connected at a first end to the second pin 36 of each support arm while a second end 52 of the lock arm selectively cooperates with a notched lock bar. Details of the function and operation of the lock bar will become more apparent below.

Figure 5:
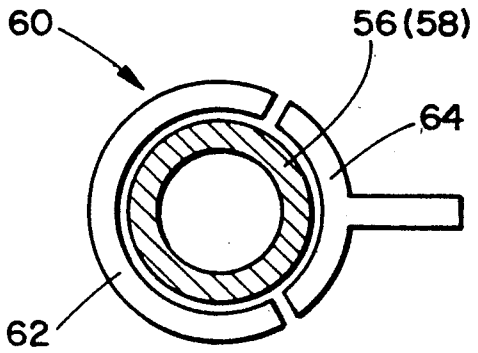
FIG. 5 is an enlarged view of a segmented bearing.
Figure 4:
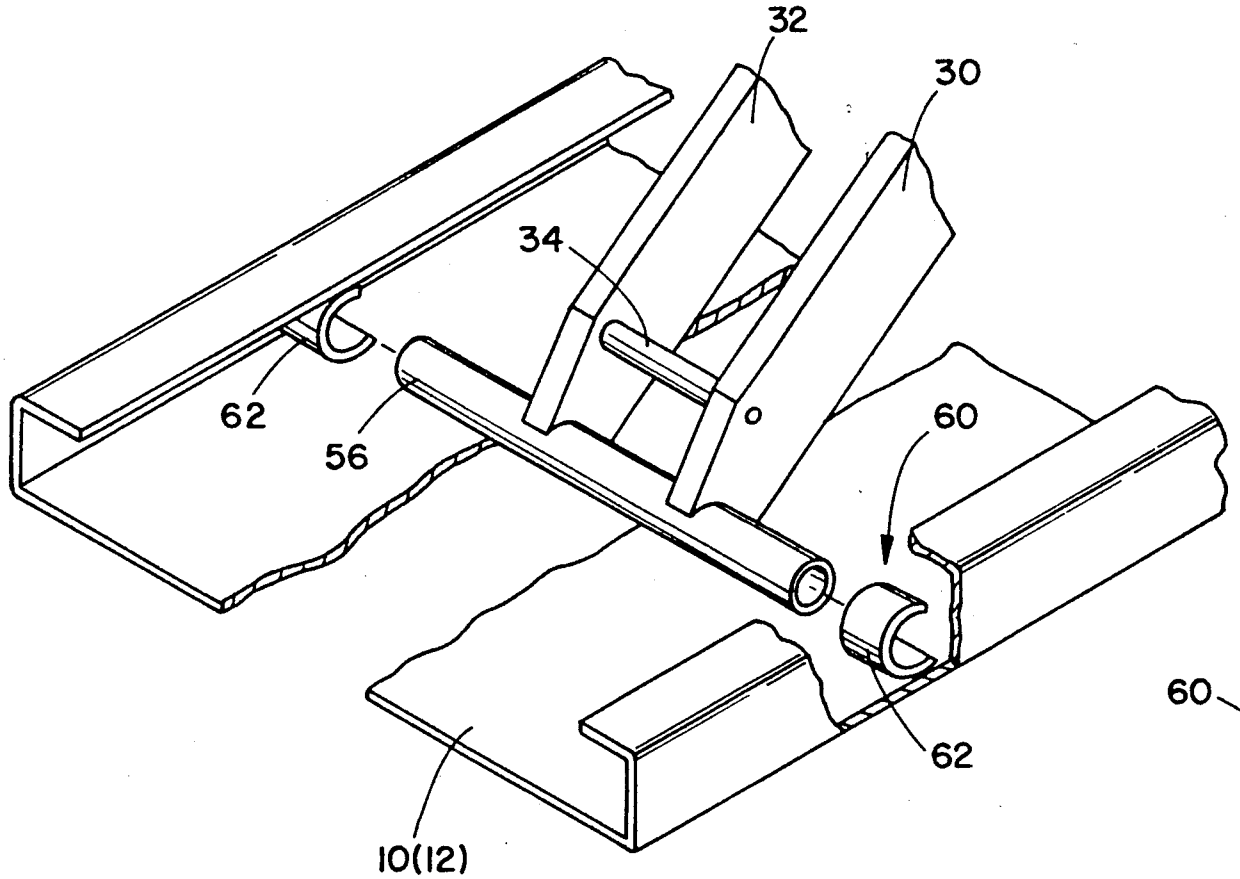
FIG. 4 is a perspective view of a link arm received in the base member.

The first end 24 of each support arm is pivotally secured to a respective base member 10 or 12 through a transversely extending link arm 56. With continued reference to FIGS. 1–3 and additional reference to FIGS. 4 and 5, it is apparent that the link arm is secured to the terminal end of each of the parallel members to define an integral structure. Opposed ends of the link arm are received in a segmented bearing assembly 60 defined on the base portions 10, 12 and the lift member.

More specifically, the segmented bearing assembly includes a first portion 62 having a generally C-shaped cross sectional configuration adapted to enclose one end of the link arm by an amount greater than 180° but less than 360°. The segmented bearing assembly offers novel operational and fabrication advantages over previous constructions. Specifically, prior linkage connections entirely encased the link arm end and defined close dimensional tolerances therewith. Although initially considered desirable, this results in a lift assembly that is unable to accommodate tolerance stackup resulting from individual manufacture of separate components that are later assembled together. The minor tolerance variations in each component are magnified when combined with other components in an assembly, resulting in a structure that may not operate as designed.

For example, and as referenced in FIG. 3, the base member C, lift member D, and adjacent support arms 22 define a conventional four bar linkage. With tolerance stackup problems, the dimensions $S+L_1$ may be greater than or less than $B+L_2$. Ideally, the summation of two adjacent sides of the trapezoidal arrangement should be equal to the sum of the next two adjacent sides. As indicated above, in reality this if often not the case and it is necessary to accommodate this inconsistency yet permit operation of the lift assembly.

The segmented bearing assemblies permit the trapezoidal arrangement to pass tension and compression forces along the longitudinal axes of the base member and lift platform. The geometry of a four bar linkage is very sensitive to the bearing spacing and the segmented bearing assembly permits automatic adjustments of this spacing. The lower bearing, i.e., the connection between the link arm 56 connecting the first end 24 of the support arm to the respective base member 10 or 12, typically encounters compressive forces imposed on the C-shaped portion 62. This results from the forces exerted on the support arm by the fluid cylinder 42 urging the link arm into the segmented bearing. On the other hand, the bearing members defined on the lift member D preferably include a second portion 64 that substantially completes the enclosure of the link arm 58, yet permits selective movement of the link arm in a direction parallel to the longitudinal axis of the base member and lift platform to transfer both compressive and tensile forces.

Another advantage offered by the segmented bearing assembly is that the entire four bar linkage is available to lift a concentrated load. Since the lift member and base member can pass forces in tension and compression along their longitudinal axes, an added moment or torque is provided to the lift cylinder to facilitate movement of the lift member. Additionally, the four bar linkage adjusts to account for manufacturing tolerances and prevents one end of the lift member from raising before the other end.

As opposed to a full sleeve bearing, as is conventionally used, the improved bearing assembly more easily accommodates lubricants. In the full sleeve bearing arrangement, the lubricant is forced out due to the close clearance between the bearing and the enclosed journal. With this assembly, though, the link arm can shift axially from one side of the C-shaped bearing portion to another without expelling the lubricant.

Still further in a conventional sleeve bearing arrangement, the dimensional clearance between the bearing and enclosed journal is generally in the range of 0.001 to 0.005 inches. According to the preferred segmented bearing assembly shown in FIGS. 4 and 5, a substantially larger clearance on the order of 0.05 to 0.06 inches is provided. This clearance provides initial or incipient line contact between the bearing and the link arm. The friction moment is thus reduced as a result of the line contact and, accordingly, the forces necessary to initiate movement of the lift member are reduced. Another advantage offered by the segmented bearings is that no bending moments are transferred to the support arms 22.

Turning now to FIGS. 6 and 7, means 70 for locking a support arm against inadvertent downward movement will be described in greater detail. As indicated above, a lock arm 50 is associated with the second pin 36 at one end of the support arm. A second end 52 of each lock arm is selectively received by a rotary lock bar 72 having plural recesses or notches 74 spaced axially therealong. The notches are all formed along the same side of the lock bar so that selective rotation of the bar about its longitudinal axis by an actuating means 76 selectively disposes the notches for engagement with the lock arm second end or, alternately, rotates the bar to a position where the lock arm second end 52 may freely slide. Further, the notches have a predetermined unequal spacing such that substantially equal incremental changes in height result when the lock arm is received therein.

More particularly, the actuating means includes a fluid cylinder such as air cylinder 80 secured at the head end 82 to one of the base portions 10 or 12. Rod end 84 of the air cylinder is secured to a bell crank arm 86 disposed on one end of the lock bar 72. Pressurizing the air cylinder extends the rod end and rotates the crank arm and lock bar in a generally clockwise arrangement as illustrated in the FIGS.

According to a preferred arrangement, the actuating means 76 includes sensing means 100 that senses two positions. First, the sensing means 100 will indicate disposition of the notches in a nonengagement position. In the preferred arrangement, the nonengagement position is defined by the piston being located at one end of the cylinder so that the rod end is fully retracted and the notches face downwardly away from engagement with the lock arm second end (FIG. 7A). The second position shown in FIG. 7C indicates that not only are the notches disposed in an engaged position, but that the lock arm is actually received and transferring load to the lock bar.

To provide an indication of both engaging and receiving the load from the lock arm, a sensor is disposed so that it will not register until the lock bar is rotated from an overcenter position and counters the air pressure imposed on the piston. As particularly illustrated in FIG. 7B, the piston is advanced rightwardly and the crank arm and lock bar rotated past the twelve o'clock position. In that position, no signal is sent to the control panel since there is no indication that the lock arm is transferring load to the lock bar. Instead, and as illustrated in FIG. 7C, the crank arm and lock bar are rotated back to the twelve o'clock or central position once the lock arm imposes or transfers a load thereto and overcomes the pressure exerted on the air actuator. Only after the lock arm has transferred its load to the lock bar will the sensing means provide a signal to the control panel to indicate to the operator that the lock bar is both in an engaged position and receiving the load. This arrangement excludes sensing of all other positions, and verifies the transfer of forces through a deliberate overtravel in conjunction with a force activated countertravel.

The sensing means may be comprised of a magnetic or metallic element provided on the piston that activates a reed switch (not shown). The specific details of the sensing means structure is not critical to the concept of verifying the engaged loaded position. Further, the amount of countertravel may vary but the verification of an engaged position in conjunction with receipt of load is the important factor.

Still another problem encountered in prior lift assemblies, and as briefly discussed above, is the nonsynchronous movement of first and second lift platforms 108, 110 that comprise the lift member D. Since each lift platform is advanced and retracted by a different set of fluid cylinders 42, 42' and since the load imposed by the vehicle B may not be equally distributed to the lift platforms, it is necessary to monitor the elevation and descension of the lift platforms relative to the base member to maintain them in synchronous relation.

Known lift assembly arrangements utilize a passive sensing that relies on operator expertise for safety concerns. That is, an operator or sensor determines that the lift platforms are not at an equal height above the base member but no means is provided to correct the situation. Typically, these arrangements utilize a torque bar tube that extends transversely between the first and second lift platforms. Opposite ends of the torque bar are welded to the lift platforms. A means for sensing a selected amount of rotation of the torque bar then provides a signal to the operator that lifting of the platforms is out of phase.

The welded torque bar arrangement also is impractical from a transportation standpoint. Particularly, if the torque bar is welded to the platforms at the place of manufacture, it becomes unwieldy and impractical to ship the assembly with the fixed spacing arrangement between the platforms. On the other hand, separate shipment of the components requires specialized equipment such as welding tools at the final destination to secure the torque bar to the lift platforms. This unnecessarily increases the cost and expense of setup.

As illustrated in FIGS. 8–11, the subject invention incorporates an equalizing and lockup sensing arrangement that monitors movement of the first and second platforms relative to the one another and in response to a sensed condition alters the movement of one platform relative to another to restore synchronous movement. Further, this arrangement is easily shipped and setup. According to the preferred arrangement, a transverse slide 114 is interposed between the first and second lift platforms. A rectangular cross section is preferred since such a configuration is more resistant to unintentional permanent deformation. In other words, the rectangular cross section will yield at the corners before total deformation of the slide occurs.

First and second arms 116, 118 extend outwardly from the first and second lift platforms 108, 110, respectively. Each of the arms has a rectangular configuration adapted to receive the rectangular cross section of the transverse slide 114. In this manner, the slide can be pushed or inserted along one arm a dimension sufficient to permit the opposite end to be removed from the other arm for disconnecting the transverse slide from the lift platforms. Conversely, one end of the slide may be advanced over one of the arms a distance sufficient to permit the other end of the slide to be received over the second arm. A pin arrangement then locks the slide into place between the arms.

Figure 8:
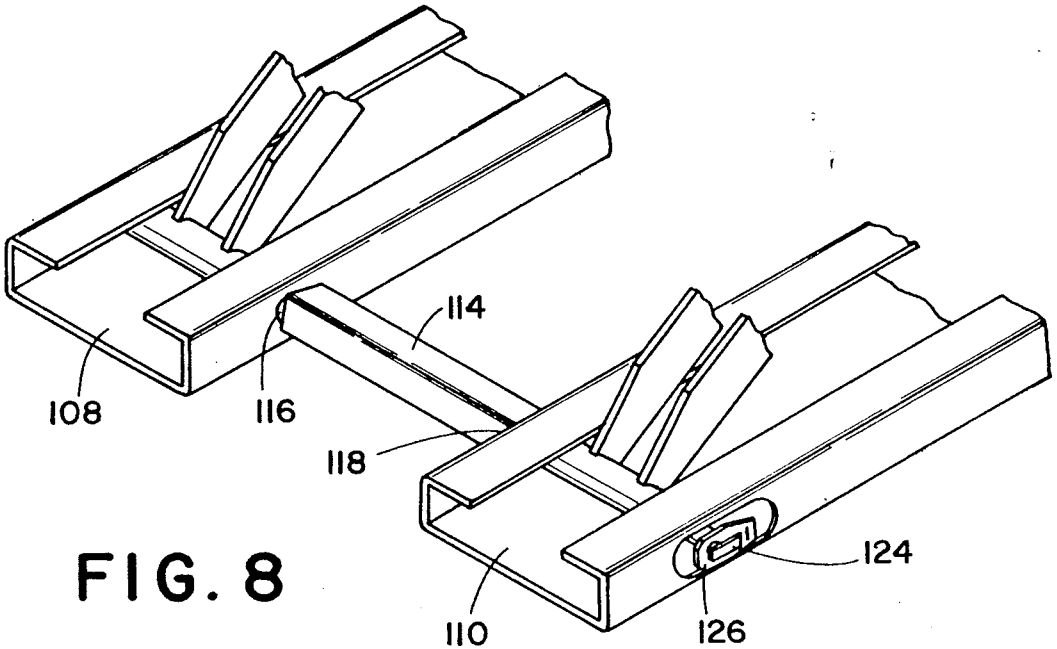
FIG. 8 is a perspective view of a coaxial torque tube used in the subject invention.
Figure 9:
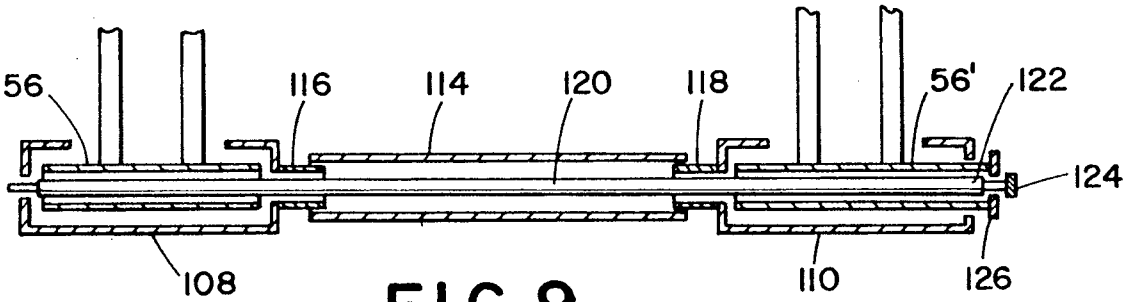
FIG. 9 is a longitudinal cross sectional view of the torque tube shown in FIG. 8.

A coaxial shaft or torque bar 120 extends through the arms 116, 118 and the hollow slide 114. Additionally, and as illustrated in FIGS. 8 and 9, opposite ends of the coaxial shaft are received through respective link arms 56 in the first and second platforms. Relative rotation between the coaxial shaft and the slide and likewise the coaxial shaft and link arm 56' is sensed at one end 122 of the coaxial shaft. As shown, an actuator 124 extends radially outward from the torque bar. An equalizing bracket 126, on, the other hand, is connected to the link arm 56.

Figure 10A:
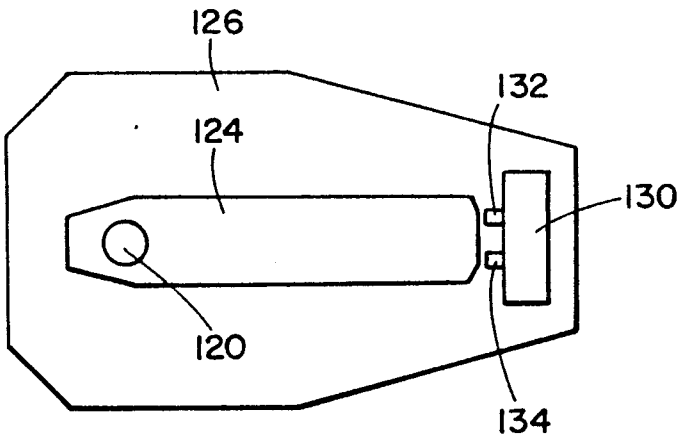
FIGS. 10A–D are side elevational views of a bracket and sensor arrangement utilized with the torque tube to indicate the position of the lift platforms relative to one another.
Figure 10B:
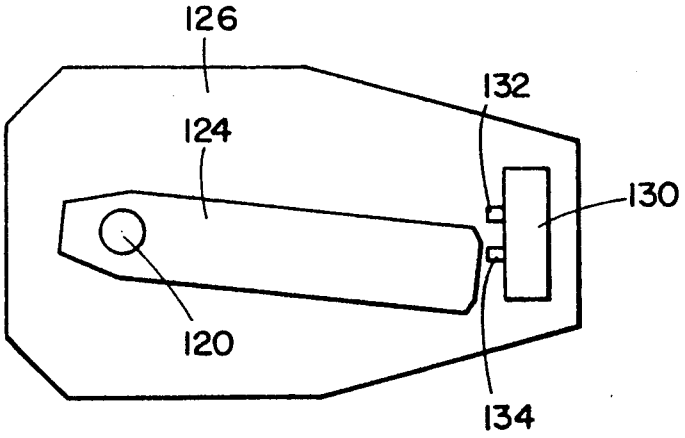
Figure 10C:
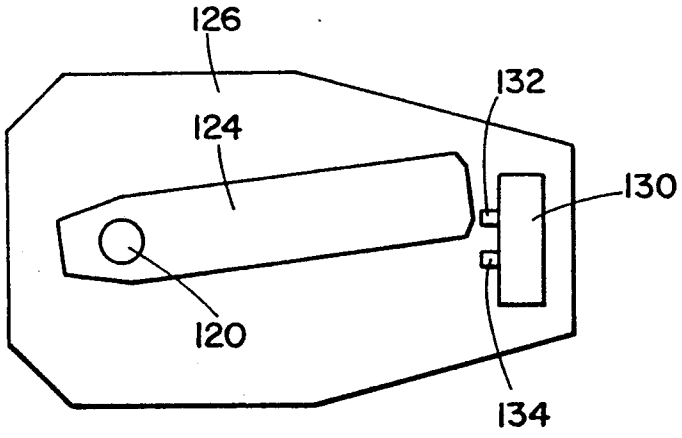

Fixedly secured on the bracket is a sensor housing 130 having first and second sensors 132, 134 capable of providing four signals representing four positional states between the coaxial shaft and slide, or coaxial shaft and link arm 56'. Particularly, where no relative rotation occurs, both sensors are actuated as illustrated in FIG. 10A. Rotation of the slide or link are 51' relative to the coaxial shaft in one direction, e.g., clockwise, will actuate only the second sensor (FIG. 10B). Likewise, minimal rotation between the coaxial shaft and slide, or link arm 56' in the opposite direction will actuate only sensor 132 (FIG. 10C). Through suitable circuitry, actuation of only one of sensors 132, 134 indicates whether the first or second platform is raised relative to the other. Lastly, if neither sensor 132 or 134 is actuated as illustrated in solid and phantom lines in FIG. 10D, too great a height differential is sensed between the platforms and movement of the lift platforms is terminated.

When the lift assembly is operating, a signed signal is provided by the sensors 132, 134. That is, if the lift platforms have lost their alignment as illustrated in FIG. 10B or 10C, then an appropriate signed signal is provided to solenoid valves to either open or close the valves and alter the supply of fluid to the appropriate fluid cylinder 42, 42'.

Figure 11:
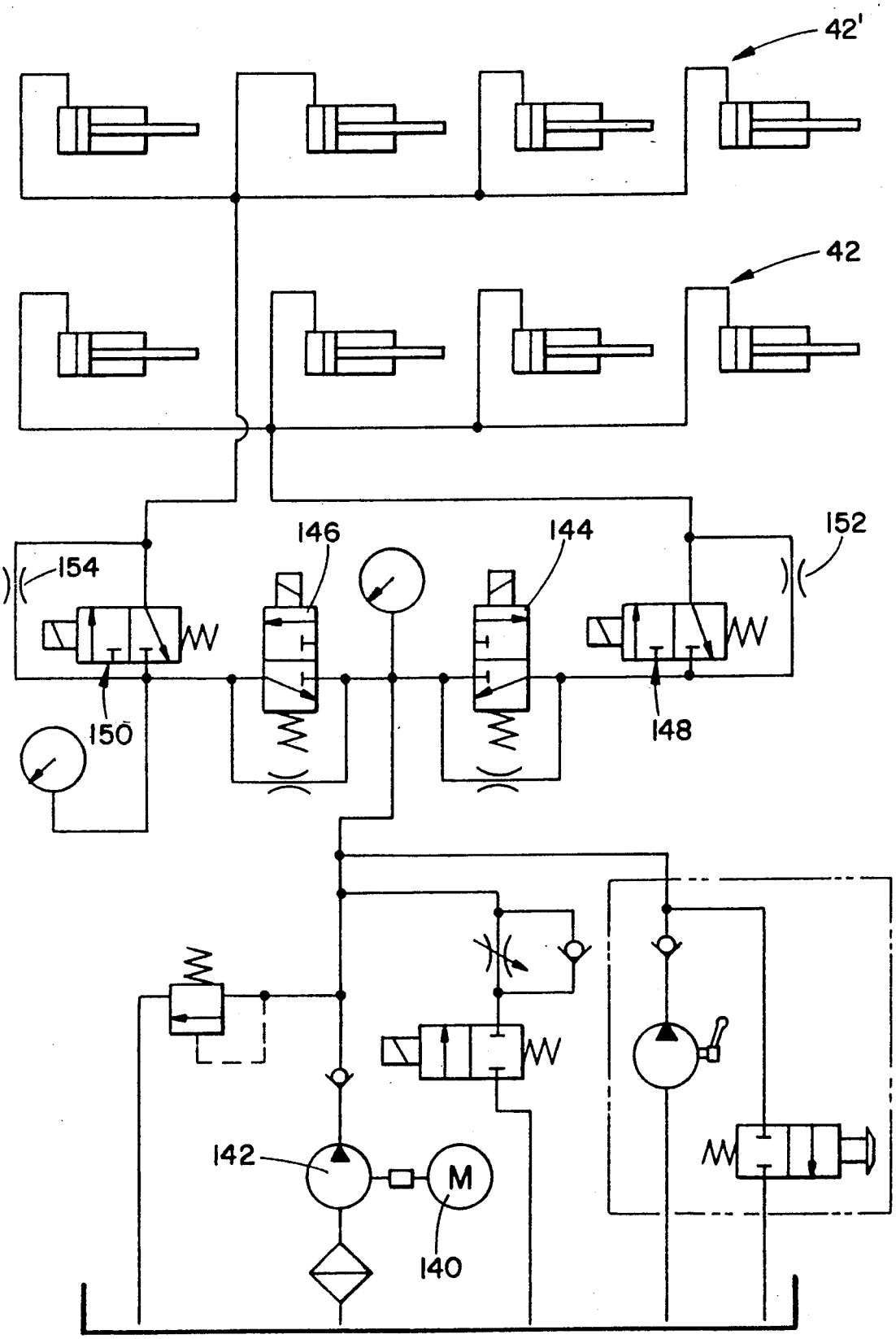
FIG. 11 is a schematic representation of a hydraulic circuit used in conjunction with the subject invention.

With additional reference to FIG. 11, a schematic of the hydraulic circuit employed to effect the equalization to the respective fluid cylinders 42, 42' is illustrated. Each of the fluid cylinders 42 is associated with one of the lift platforms while fluid cylinders 42' are associated with the other lift platform. A motor 140 operates pump 142 to supply pressurized fluid to the cylinders. First and second solenoid actuated lockout valves 144, 146 receive the pressurized fluid from the pump. These valves are normally closed as indicated by the spring biased, two position, two-way solenoid actuated valve. As long as a signal from either sensor 132 or 134 is present, these lockout valves are moved to a valve open position. Pressurized fluid can then be supplied to equalization valves 148, 150. The equalization valves are also twoway, two-position, spring biased solenoid actuated valves. The solenoid actuated valves 148, 150 are placed in parallel with an associated throttle passage 152, 154. Since the valves are normally open, pressurized fluid is provided to the head end of the cylinders and the lift platforms 108, 110 raised. If movement of the lift platforms becomes non-synchronous, as represented in either FIGURE 10B or 10C, the appropriate equalization valve 148, 150 is closed so that fluid to that half of the lift assembly passes through throttle 152 or 154. This permits the other side of the lift assembly to "catch up" since a greater supply of pressurized fluid is provided to the appropriate fluid cylinders. Once the lift platforms have equalized, both sensors 132, 134 are actuated and the equalization valves returned to the open position.

Figure 10D:
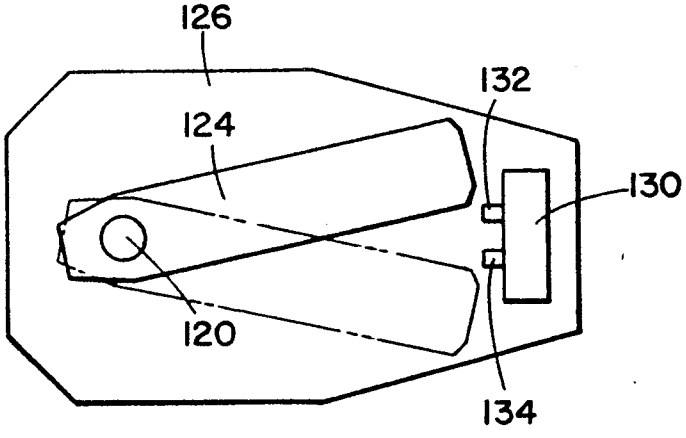

If for some reason the condition of FIGS. 10B and 10C is not corrected quickly enough to equalize the lift platforms, the coaxial shaft sensing arrangement will reach the position shown in FIG. 10D. Under such a condition, the lockout valves 144, 146 are "deactuated" and all movement of the lift platforms terminated.

Referring again to FIG. 2, a trolley or work tray 160 extends between the lift platforms 108, 110. Preferably, the trolley is movable in a direction parallel to the longitudinal axes of the lift platforms. The trolley according to the preferred embodiment includes means for selectively extending the transverse dimension thereof to accommodate any practical irregularities in the theoretically parallel lift platforms. Thus, overlapping channels or similar extension type devices can be provided on the trolley. Disposed on the trolley are first and second lift jack assemblies 162, 164. The lift jack assemblies are adapted to independently elevate the vehicle B relative to the lift platforms. This facilitates maintenance of the tires, brakes, and the like while the entire vehicle is elevated above the base member.

Figure 12:
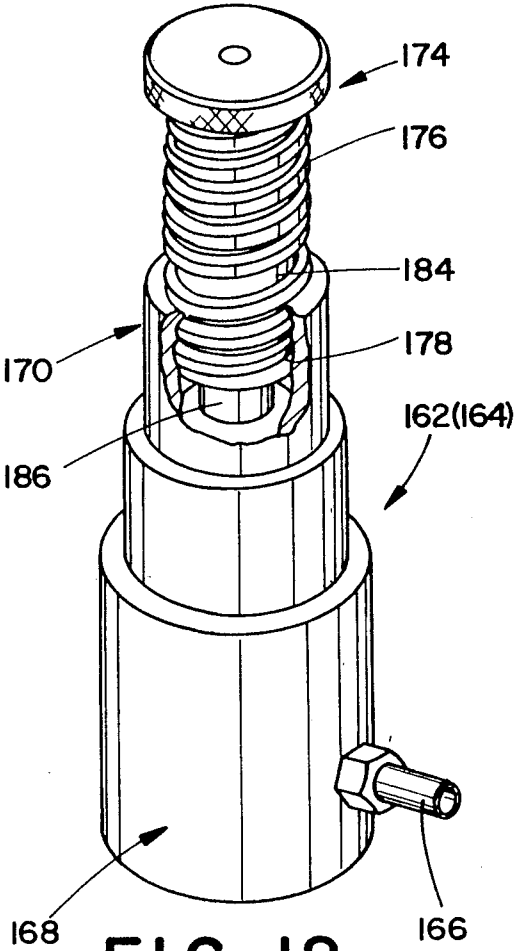
FIG. 12 is a perspective view of a lift jack assembly with selected portions broken away.

With more particular reference to FIG. 12, one of the lift jack assemblies is illustrated in greater detail. As illustrated therein, the lift jack assembly preferably includes a single-acting, telescopic fluid cylinder. Accordingly, a single fluid passage 166 is located at the first or lower end 168. At a second or upper end 170 a manually adjustable portion 174 is provided. In this particular arrangement, the manually adjusted portion is exteriorly threaded at 176 to cooperate with internal threads 178. As is conventional, the manually adjustable portion is rotated in one direction to extend the lift jack assembly into engagement with the underside of the vehicle. Thereafter, lifting of the vehicle is accomplished by pressurizing the cylinder. Since the manually adjustable portion is more often rotated to extend the jack assembly than to retract it, the potential exists that the manually adjustable portion can be so extended relative to the fluid cylinder as to become non-load bearing, unstable, or perhaps fall out.

In an effort to reduce such incidents, a warning band 184 is provided approximately two-thirds of the way along the axial extent of the external threads. By use of a brightly colored warning band, an operator will be made aware of the limited thread maintaining the manually adjustable portion in the lift jack assembly. Further, the lower end of the manually adjustable portion includes an elongated, reduced diameter portion 186. Thus, if the warning band is overlooked or ignored and the manually adjustable portion becomes entirely unthreaded from the lift jack assembly, the reduced diameter portion will still stabilize and support the load.

Figure 13:
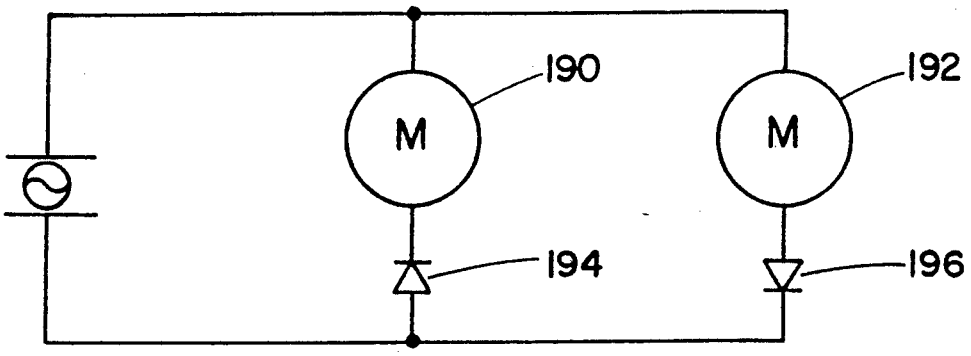
FIG. 13 is a schematic representation of the synchronizing circuit for the lift jack motors.

It is also important to maintain the movement of the lift jack assemblies 162, 164 in synchronous relation. To achieve synchronous action, it is contemplated that a 24 volt AC supply is connected in a unique manner to electric motors 190, 192 (FIG. 13). Incorporating diodes 194, 196 into the circuit with the first and second motors 190, 192, respectively, in effect, splits the alternating current into a pulsating direct current. Each motor, effectively, receives a 12 volt DC supply. The frequency is high enough that even though the motors receive alternate DC pulses of the AC current, the motors substantially receive power in unison. This aids in synchronization of the single acting fluid cylinders of the lift jack assemblies 162, 164 powered by the motors 190, 192, respectively.

As indicated above, preferably each lift jack assembly includes a single-acting, telescopic cylinder. Operators are warned against running a pump in reverse to remove fluid from a single-acting cylinder. Running the pump in reverse induces a vacuum or suction on the single-acting cylinder. This normally would be desirable to remove fluid from the head end of a cylinder but, instead, either (i) the pump takes fluid from the sump without removing the fluid from the cylinder, or (ii) potential cavitation problems result with the pump due to an insufficient supply of hydraulic fluid as the head end of the cylinder is retracted.

Figure 14:
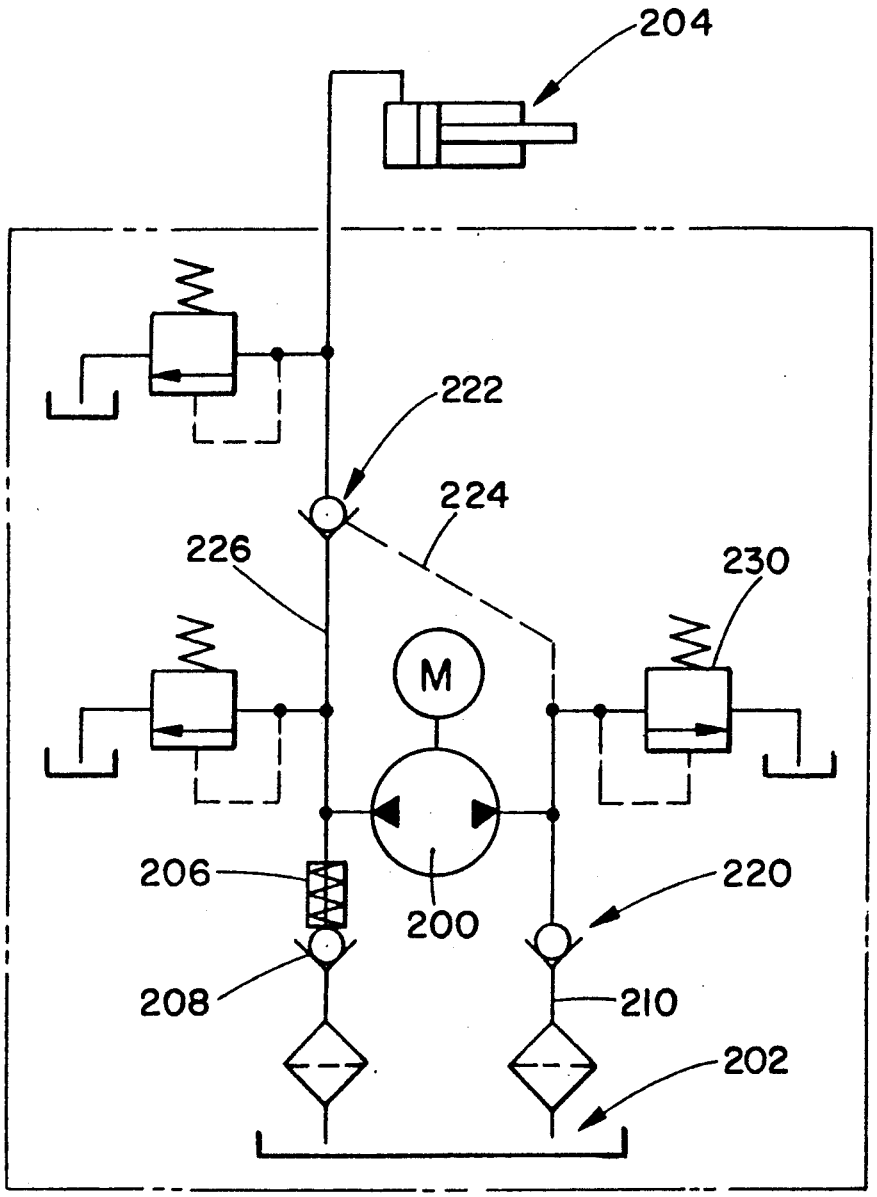
FIG. 14 is a schematic representation of the use of a pump to retract a single acting fluid cylinder in accordance with the principles of the invention.

As illustrated in FIG. 14, pump 200 communicates between reservoir 202 and a single-acting cylinder 204 representative of the single-acting cylinders in the lift jack assemblies. It is contemplated that use of biasing means such as spring 206 in check valve 208 with the pump will overcome the previously encountered problems in withdrawing fluid from a single-acting cylinder. Operation of the pump to supply pressurized fluid to the head end of the cylinder will elevate the lift jack assemblies, as expected. Fluid is obtained through passage 210 from the reservoir, passes through check valve 220, through the pump, and through yet another check valve 222 before pressurizing the head end of the cylinder.

The check valve 222 maintains the load in a raised position until an operator reverses the direction of the bi-directional pump 200. Running the pump in reverse opens check valve 222 through pilot line 224 so that fluid from the head end of the cylinder can reach the pump through passage 226. The load imposed on the cylinder initially "pushes" the fluid from the cylinder 204 once check valve 222 opens. The fluid then passes through the pump and reaches the reservoir through relief valve 230. Once the load has partially retracted the cylinder, the pump must "suck" the remaining fluid from the cylinder to completely retract the cylinder. In prior arrangements, the pump when operated in reverse with a single-acting cylinder, would encounter cavitation problems as a result of an insufficient supply of fluid to satisfy the pump. Thus, specific warnings were provided to limit use of a pump to draw down a single-acting cylinder.

Inclusion of another check valve 208 into the circuit eliminates the cavitation problem but results in an arrangement where the pump draws fluid from the reservoir or sump and fails to draw down the cylinder. According to the preferred embodiment, the circuit of FIG. 14 includes a means for biasing the check valve 208 to overcome this problem. Specifically, the biasing means is defined by a spring 206 that places a predetermined load on the check valve 208 so that the pump will first draw down the cylinder, but is readily replenished by fluid through the reservoir if suction forces overcome the spring bias. This arrangement advantageously permits the a bidirectional pump to retract a single-acting cylinder without encountering problems associated with prior arrangements. Thus, a less expensive single-acting cylinder can be utilized with a pump to provide the attributes of a double-acting cylinder, not for purposes of moving a load, but merely to retract the fluid cylinders.

The invention has been described with reference to the preferred embodiment. Obviously, modifications and alterations will occur to others upon a reading and understanding of the specification. It is intended to include all such modifications and alterations insofar as they come within the scope of the appended claims or the equivalents thereof.

Having thus described the invention, it is now claimed:

1. A lift assembly comprising:

a base member;

first and second lift platforms operatively connected to the base member;

means for selectively moving the lift platforms toward and away from the base member; and means for synchronizing movement of the first and second lift platforms relative to the base member, the synchronizing means including means for sensing height differential between the lift platforms including first and second arms interconnecting the lift platforms with the base member, a lateral member operatively engaging one of the first and second arms and extending between the first and second arms, and means for sensing relative rotational movement between the arms indicating height differential between the platforms.

2. The lift assembly as defined in claim 1 wherein the synchronizing means includes first and second fluid cylinders controlling movement of the first and second lift platforms, respectively, and means for regulating fluid flow to the fluid cylinders in response to the sensing means.

3. The lift assembly as defined in claim 2 wherein the synchronizing means includes means for throttling fluid to a selected fluid cylinder in response to the sensing means.

4. The lift assembly as defined in claim 1 wherein the sensing means includes two position indicators so that the rotational direction of the lateral member can be determined.

5. The lift assembly as defined in claim 1 further comprising means for locking the lift platforms at a predetermined position.

6. The lift assembly as defined in claim 5 wherein the locking means includes a bar having plural notches spaced therealong for receiving a lock arm associated with the lift platforms.

7. The lift assembly as defined in claim 6 further comprising means for indicating orientation of the notched bar for receipt of the lock arm.

8. The lift assembly as defined in claim 7 wherein the locking means includes an actuator for orienting the notched bar between lock and unlock positions, and the indicating means includes a sensor designating the position of the actuator.

9. The lift assembly as defined in claim 6 wherein the notches are disposed in non-linear relationship along the bar to provide uniform incremental lift heights off the platforms relative to the base member.

10. The lift assembly as defined in claim 1 wherein each arm is connected to the respective lift platforms through a segmented bearing that permits complete transfer of compressive and tensile forces therethrough and accommodates tolerance build up between the arms and linkage.

11. The lift assembly as defined in claim 10 wherein the segmented bearing includes a generally C-shaped bearing on the lift platform receiving a journal disposed on the linkage arm.

12. The lift assembly as defined in claim 11 wherein the bearing is enlarged relative to the journal to promote line contact therebetween.

13. The lift assembly as defined in claim 1 further comprising a lift jack assembly associated with the first and second lift platforms for raising and lowering loads relative to the lift platforms.

14. The lift assembly as defined in claim 13 wherein the lift jack assembly includes a single acting fluid cylinder operated by a bi-directional pump, and means for operating the pump in reverse without cavitating the pump to retract the fluid cylinder.

15. The lift assembly as defined in claim 14 wherein the reverse operating means includes a check valve arrangement associated with the bi-directional pump to permit the pump to maintain a supply of fluid from reservoir while drawing fluid from the single acting fluid cylinder.

16. The lift assembly as defined in claim 13 wherein the lift jack assembly includes a manually operated portion having an extension limit warning indicia.

17. The lift assembly as defined in claim 16 wherein the manually operated portion includes an extension that supports the load and prevents further advancement of the manually operated portion.

18. The lift assembly as defined in claim 13 further comprising first and second lift jack assemblies operated by first and second electric motors, and means for rectifying an alternating current into a reduced voltage, pulsating direct current to synchronously operate the first and second motors.

19. A lift assembly comprising:

a base member;

a lift member adapted for selective movement toward and away from the base member;

first and second support arms interconnecting the base member and the lift member and defining a generally trapezoidal arrangement;

means for accommodating tolerance stackup such that any two adjacent sides of the generally trapezoidal arrangement is substantially equal to the remaining two adjacent sides.

20. The lift assembly as defined in claim 19 wherein the accommodating. means is defined by segmented bearings interposed between the base member and the first and second support arms.

21. The lift assembly as defined in claim 20 wherein the accommodating means further includes segmented bearings interposed between the lift member and the first and second support arms.

22. The lift assembly as defined in claim 21 wherein the segmented bearings include a generally C-shaped portion that partially encloses a link arm associated with each support arm.

23. The lift assembly as defined in claim 22 wherein the segmented bearings interposed between the lift member and the first and second support arms include a second portion that cooperates with the C-shaped portion to substantially enclose the link arms associated with the support arms.

24. The lift assembly as defined in claim 19 wherein the lift member includes first and second lift platforms, and means for synchronizing movement of the first and second lift platforms relative to the base member.

25. The lift assembly as defined in claim 27 wherein the synchronizing means includes means for sensing height differential between the first and second lift platforms.

26. A lift assembly comprising:

a base member;

a lift member adapted for selective raising and lowering relative to the base member;

means for selectively locking the lift member at a preselected height above the base member; and means for sensing that said locking means is properly oriented and that the lift member is loaded, the sensing means including a lock bar having a series of notches therein adapted to receive a lock arm interposed between the lift member, and a fluid actuator that selectively rotates the lock bar.

27. The lift assembly as defined in claim 26 wherein the sensing means includes first and second sensors that indicate a fully retracted position and an intermediate position of a piston associated with the fluid actuator.

28. A lift assembly comprising:

a base member;

a lift member operatively connected to the base member;

means for selectively moving the lift member toward and away from the base member;

a bar having plural notches spaced in non-linear relationship for receiving a lock arm associated with the lift member and provide uniform incremental lift heights of the lift member; and means for indicating orientation of the notched bar for receipt of the lock arm.

29. A lift assembly comprising:

a base member;

a lift member;

first and second arms linking the base member and lift member together; and each arm connected too the lift member through a segmented bearing that permits complete transfer of compressive and tensile forces through and accommodates tolerance build up between the arms, base member and lift member.

30. The lift assembly as defined in claim 29 wherein each segmented bearing includes a generally C-shaped bearing on the lift member receiving a journal disposed on the arm.

31. The lift assembly as defined in claim 30 wherein the bearing is enlarged relative to the journal to promote line contact therebetween.

32. A lift assembly comprising:

a base member;

a lift member operatively connected to the base member;

means for selectively moving the lift member toward and away from the base member;

first and second lift jack assemblies associated with the lift member for raising and lowering loads relative to the lift member, the lift jack assemblies being operated by first and second electric motors; and means for rectifying and alternating current into a reduced voltage, pulsating direct current to synchronously operate the first and second motors.

33. A lift assembly comprising:

a base member;

a lift member operatively connected to the base member;

means for selectively raising and lowering the lift member relative to the base member;

a lift jack assembly having a single acting fluid cylinder operated by a bi-directional pump, the lift jack assembly being associated with the lift member for raising and lowering loads relative to the lift member; and means for operating the pump in reverse without cavitating the pump to retract the fluid cylinder.

34. The lift assembly as defined in claim 33 wherein the reverse operating means includes a check valve arrangement associated with the bi-directional pump to permit the pump to maintain a supply of fluid from reservoir while drawing fluid from the single acting fluid cylinder.

35. A lift assembly comprising:

a base member;

first and second lift platforms operatively connected to the base member;

means for selectively moving the lift platforms toward and away from the base member; and means for synchronizing movement of the first and second lift platforms relative to the base member, the synchronizing means including a shaft extending between the lift platforms and means for sensing height differential between the lift platforms wherein said synchronizing means equalizes the lift platforms if the height differential is limited and terminates in movement of the lift platforms if the limited height differential is exceeded.

* * * * *